United States Patent [19]

Sherman

[11] 4,043,313

[45] Aug. 23, 1977

[54] FIREPLACE CHIMNEY FURNACE

[76] Inventor: Larry P. Sherman, 430 East St., Muir, Mich. 48860

[21] Appl. No.: 649,401

[22] Filed: Jan. 15, 1976

[51] Int. Cl.[2] ..... F24B 7/04

[52] U.S. Cl. ..... 126/121; 126/122; 126/143

[58] Field of Search ..... 126/121, 122, 143, 85 B; 237/51, 288

[56] References Cited

U.S. PATENT DOCUMENTS

| | | | |
|---|---|---|---|
| 578,240 | 3/1897 | Humphreys | 126/122 |
| 1,706,768 | 3/1929 | Brewster | 126/121 |
| 2,184,701 | 12/1939 | Kriechbaum et al. | 236/16 |
| 2,277,381 | 3/1942 | Black | 126/121 |
| 2,407,590 | 9/1946 | Vineberg | 126/121 |
| 2,622,587 | 12/1952 | Dupler | 126/121 |
| 2,671,440 | 3/1954 | Dupler | 126/121 |
| 3,066,423 | 12/1962 | Solem | 34/86 |
| 3,724,443 | 4/1973 | Carson | 126/121 |
| 3,834,619 | 9/1974 | Glover | 126/121 |
| 3,888,231 | 6/1975 | Galluzzo et al. | 126/121 |

FOREIGN PATENT DOCUMENTS

| | | | |
|---|---|---|---|
| 892,352 | 3/1962 | United Kingdom | 126/121 |

*Primary Examiner*—John J. Camby
*Assistant Examiner*—Larry I. Schwartz
*Attorney, Agent, or Firm*—Ian C. McLeod

[57] ABSTRACT

A heat exchanging chimney in the form of a tubular heat exchanger which functions as a furnace and which is mounted above a conventional fireplace with a preferably transparent or translucent closure means over the front is described. The fireplace is constructed such that it draws outside air for combustion of the fuel and not air from the rooms being heated. The chimney is specifically in the form of at least one vertically oriented multiple tube shell type heat exchanger in place of the conventional fireplace chimney wherein the flue gases pass inside the tubes and the room air is heated inside the shell. In operation, the fireplace and heat exchanging chimney achieve substantial economies in utilization of fuel, particularly wood, over fireplaces with conventional chimneys.

12 Claims, 8 Drawing Figures

FIREPLACE CHIMNEY FURNACE

SUMMARY OF INVENTION

The present invention generally relates to an improved apparatus for the reocvery of the heat from fireplace flue gases by means of a vertically oriented tubular shell type heat exchanger mounted above the fireplace. In particular, the present invention relates to a fireplace which utilizes outside air for combustion of the fuel rather than air from the rooms being heated.

Prior Art

The prior art is illustrated by U.S. Pat. Nos. 172,656; 916,559; 1,681,995; 1,727,228; 2,430,393; 2,622,587; 2,789,554; 2,791,213; and 3,834,619. These patents generally show fireplaces where some heat exchange is achieved between the flue gases from the fireplace and room heating air in the fireplace shell. In many of these units, the air for the combustion of the fuel is provided through an open front of the fireplace. This construction produces a major source of heat loss from the building even when the fireplace is not in use and is inefficient since heated room air passes up the chimney after being utilized at least partially for combustion of the fuel. Such a system is basically illustrated in Bennett U.S. Pat. No. 172,656 (1876) and Jones U.S. Pat. No. 916,559 (1909) and has been suggested more recently by Glover in U.S. Pat. No. 3,834,619 (1974).

U.S. Pat. No. 2,622,587 to Dupler shows a complex form of fireplace device wherein outside air is brought into the fire chamber. In this device, an attempt was made to make the heat exchanger as small and compact as possible within the general confines of the fireplace housing, probably to provide a unit which can be a substitute for the conventional fireplace. As a result, the flow of the flue gases is restricted by the sharp bends in the tubes forming the heat exchanger.

OBJECTS

It is therefore an object of the present invention to provide a fireplace chimney furnace which does not use air from inside the rooms of the building for combustion of the fuel. Further it is an object of the present invention to provide such a furnace which achieves maximum heat transfer from the flue gases without impeding the flow of flue gases as they are expelled from the fireplace. Further still, it is an object of the present invention to provide such a furnace which is simple and economical to construct by comparison to a conventional fireplace chimney made of brick and which is more efficient in terms of fuel economy than a conventional fireplace. These and other objects will become apparent to those skilled in the art by reference to the following description and by reference to the drawings.

IN THE DRAWINGS

Figure 6:
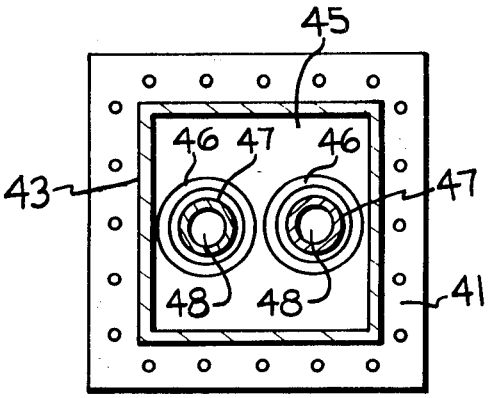
Figure 5:
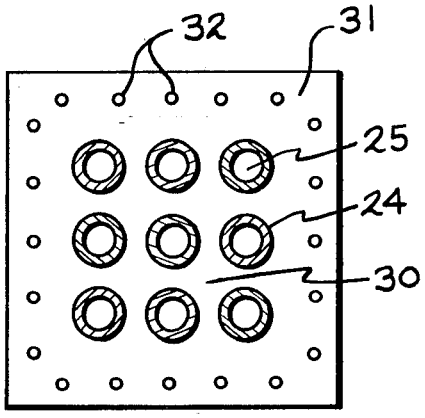
Figure 4:
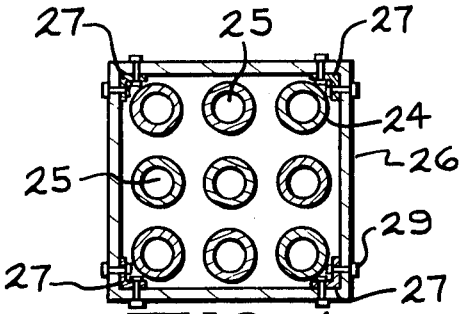
Figure 3:
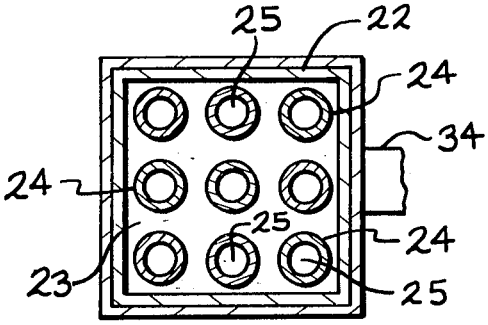

FIG. 3 is a plan cross-sectional view along line 3—3; FIG. 4 is a plan cross-sectional view along line 4—4; FIG. 5 is a plan cross-sectional view along line 5—5 and FIG. 6 is a plan cross-sectional view along line 6—6 of FIG. 1, particularly illustrating various sections of the primary and secondary shell type heat exchangers of the fireplace chimney of the present invention.

Figure 7:
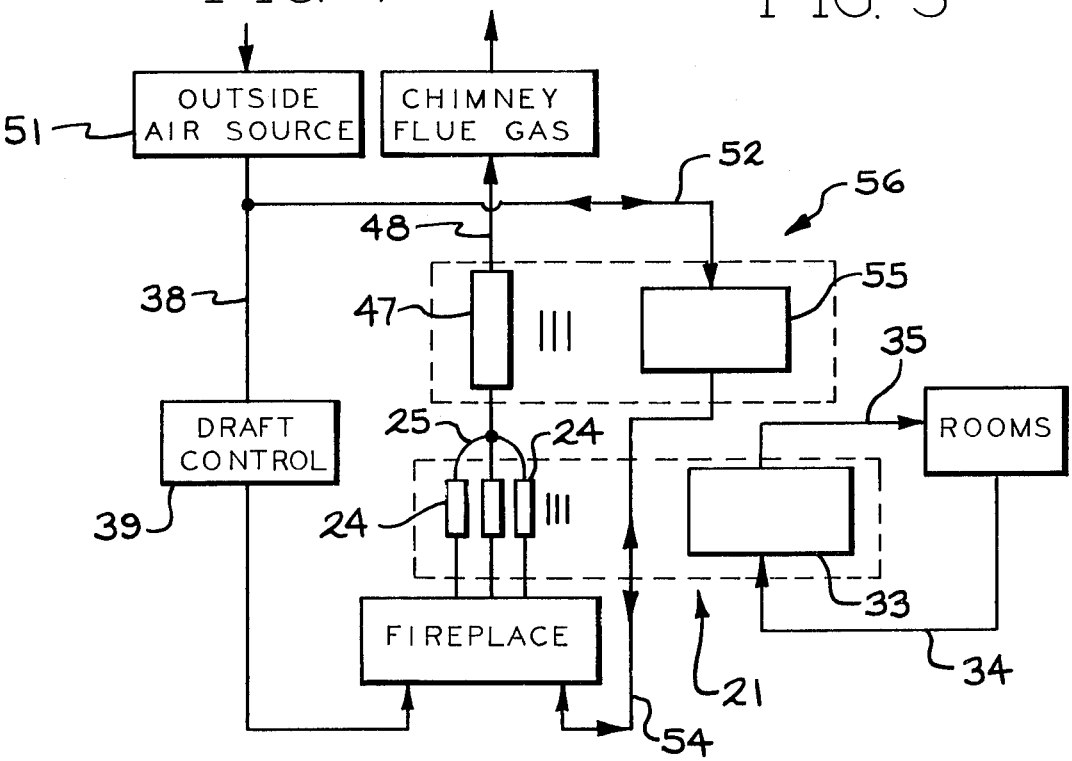

FIG. 7 is a schematic diagram of the fireplace chimney furnace of FIGS. 1 to 6, particularly illustrating the flow of flue gases as well as the flow of the combustion and heating air.

Figure 8:
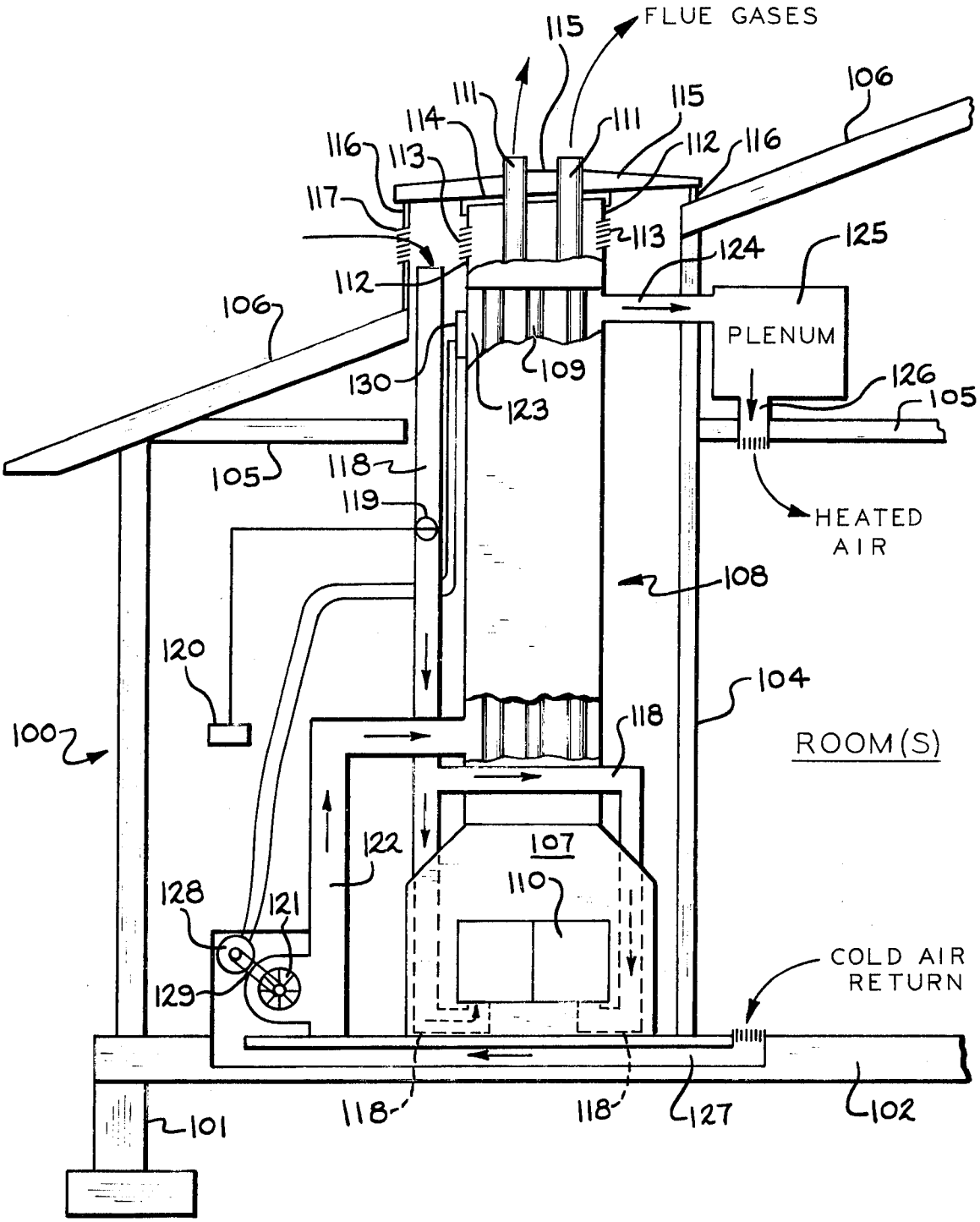

FIG. 8 is a schematic front cross-sectional view of a building illustrating a variation of the fireplace chimney which uses a primary heat exchanger and a plenum for the heated air with a conventional blower system.

GENERAL DESCRIPTION

The present invention relates to an improvement in a building with a fireplace having a combustion chamber, a front opening leading into a room and means for closing the opening and having a flue gas exit from the fireplace, as a replacement for a conventional fireplace chimney which comprises: multiple heat exchanging tubes mounted above the flue gas exit of the fireplace such that the flue gases vent upward through vertically oriented openings in the tubes, wherein the tubes extend substantially between at least a floor and a ceiling of a room of the building; a housing surrounding, supporting and enclosing the tubes except for the openings with at least one conduit for cold air inlet into the housing and at least one conduit for hot air exit from the housing into at least one room of the building; a chimney in sealed gaseous connection with the openings in the tubes and leading outside the building which provides an exit for the flue gases from the tubes of the heat exchanger; and an air conduit leading from outside of the building to the bottom of the combustion chamber. By using the multiple tube heat exchanger in place of a conventional chimney for the fireplace, large amounts of heat which would be wasted by a conventional chimney can be economically recovered. Because the openings in the tubes are vertically oriented, the venting of the flue gases is unrestricted.

The vertically oriented tubes can be either straight, which is preferred, or they can have slight bends which do not significantly impede the flow of the flue gases. The tubes can have fins on the outside and the like for better heat transfer to heat the heating air. Preferably the tubes are made of metal such as steel pipe.

In general the fireplace chimney is constructed in a manner which uses safe construction practice. This practice is well known to those skilled in the art. It is preferred that the air inlet and exchanger except for the fireplace be enclosed in a separate room.

Particularly preferred is the use of a secondary tubular heat exchanger mounted above the first heat exchanger such that the flue gases pass inside the tubes, wherein the second tubes are enclosed by a housing, wherein a second outside air conduit is provided in the second housing such that air can pass around the second tubes and wherein a second conduit is provided leading from the second housing to the bottom of the combustion chamber. The preferred construction initially allows the heating of inlet fireplace air by the secondary exchanger, since air flows to the combustion chamber. As the system approaches a stable temperature, the air flow automatically reverses and excess air is taken from the bottom of the combustion chamber to keep the fire damped and burning under control. In the most preferred form, the direct air inlet to the fireplace is coupled by a plenum to the air inlet to the secondary exchanger so that preheated air is supplied to the combustion chamber regardless of the direction of air flow in the secondary exchanger.

SPECIFIC DESCRIPTION

Figure 1:
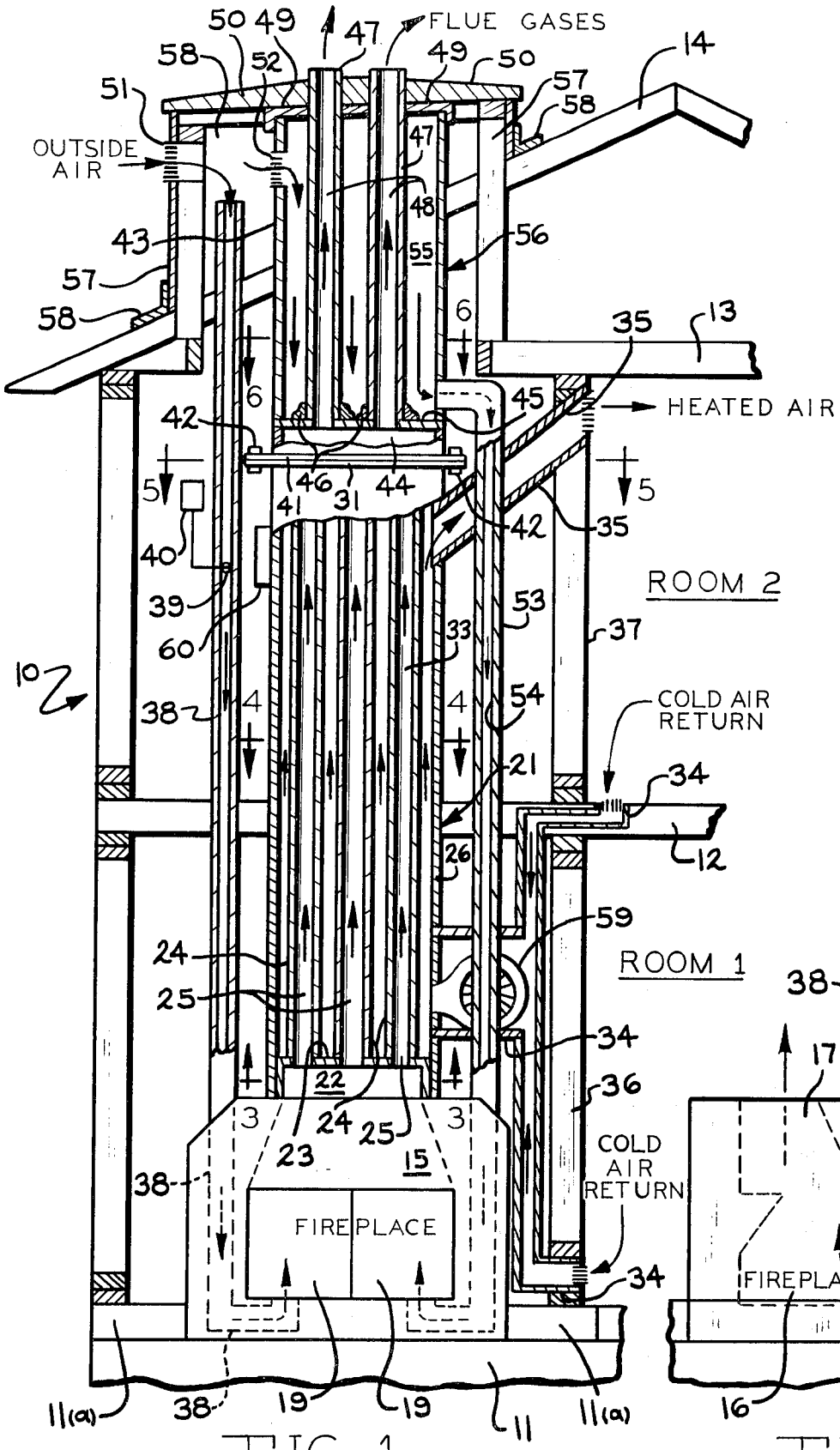
FIG. 1 is a front cross-sectional view of a building, particularly illustrating in a front cross-sectional view the preferred fireplace chimney furnace of the present invention with a lower primary and an upper secondary shell type exchanger in position.
Figure 2:
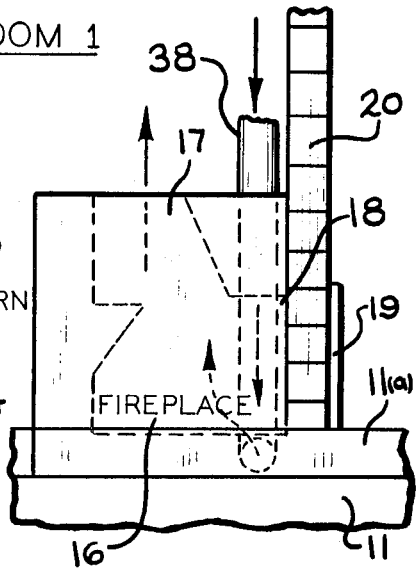
FIG. 2 is a partial side cross-sectional view of the fireplace shown in FIG. 1.

Referring to FIGS. 1 and 2, the preferred embodiment of the present invention is illustrated in the setting of a building 10 having a conventional basement floor 11 supporting a hearth 11(*a*) of brick or the like, a first floor 12, a ceiling 13 and pitched roof 14. As can be seen from FIG. 1, the preferred fireplace chimney furnace of the present invention extends from above a conventional fireplace 15 to above the roof 14 in a generally vertical orientation. The fireplace 15 can be of the preformed type and made of concrete or can be made from bricks.

The fireplace 15 is placed on the basement floor 11 and has a conventional fire chamber 16 with an upwardly extending flue gas exhaust port 17. A conventional front opening 18 is provided in the fireplace 15 which is closed by glass covered access doors 19 or other closure means which can radiate heat into a room in front of the fireplace. The front or face of the fireplace 15 can be provided with decorative brick 20 as shown in FIG. 2.

The tubular exchanger unit 21 of the present invention is preferably mounted directly on the exhaust port 17 of the fireplace 15. The unit 21 is constructed such that flue gases rise vertically from the port 17 into a plenum or chamber 22 formed of sheet metal having a top 23. Vertically oriented tubes 24 having openings 25 extend above the plenum 22 through which flue gases can pass. The construction of the plenum 22 can best be seen by reference to the cross-section in FIG. 3. Surrounding the tubes 24 is a housing 26 which is preferably made of galvanized sheet steel. As shown in FIG. 1, the tubes 24 extend above and below the first floor 12; however, it will be appreciated that the tubes 24 could extend between any number of floors. A cross-section of the heat exchanger unit 21 is shown in FIG. 4, wherein the housing 26 is shown as supported by vertically positioned angle irons 27 secured to the inside of the housing 26 by metal screws 29. Conventional furnace sealing (not shown) such as asbestos or furnace cement can be used between the fireplace 15 and exchanger 21.

At the uppermost part of the housing 26 is provided an end or closure plate 30 which supports ends of tubes 24 around the openings 25, as shown in FIGS. 1 and 5. Integrally formed with the plate 30 is a flange 31 extending perpendicularly to the central longitudinal axis of the tubes 24. The flange 31 is provided with bolt holes 32 and is constructed such that it fits in mating relationship with a similarly constructed flange 41 as set forth hereinafter. The housing 26 and plates 23 and 30 seal the tubes 24 such that a chamber 33 is provided surrounding the tubes 24.

At the floors of rooms 1 and 2 are provided conduits 34 leading into the chamber 33. The chamber 33 is also provided with a second conduit 35 leading into an upstairs room 2 above the fireplace 15. The conduit 35 directs the heated air leaving the housing 26 upward and into the rooms preferably at an angle between about 30° and 45° from the horizontal plane. The conduits 34 and 35 are supported by two walls 36 and 37 extending between the floors 11 and 12 and the ceiling 13 in the rooms 1 and 2.

Through one side and underside of the fireplace 15, is provided a conduit 38 which extends through the roof 14 to provide outside air to the bottom of the fire chamber 16. The conduit 38 is provided with a butterfly valve 39 which functions as an air damper. Preferably a thermostat 40 regulates the valve 39 to automatically maintain the desired temperature in room 2.

Mated to the flange 31 is a second flange 41. The flanges 31 and 41 are secured together by bolts 42 and conventional sealing agents such as asbestos tape and furnace cement can be used to insure a seal. Attached to the flange 41 is a box-like rectangularly cross-sectioned housing 43 which is also shown in FIG. 6. Adjacent the flange 41 is a plenum 44 with a top plate 45 secured to the sides of the housing 43. A pair of circular flanges 46 are mounted on the top plate 45 which mount verticallly oriented steel chimney pipes 47 having openings 48 for the exit of the flue gases and have a cross-sectioned area equal to or greater than the sum of the areas of the openings 25 of the multiple tubes 24. The pipes 47 are supported at their uppermost ends by a plate 49 which is fitted to and encloses the housing 43. As shown in FIG. 1, the pipes 47 and air inlet conduit 38 are surrounded by a decorative chimney 57 with a rectangular cross-section and with a louvered opening 51 on the side for air entry as shown by the arrows. The chimney 57 should be adequately spaced from the housing 43 if it is made of wood as shown in FIG. 1. Brick (not shown) can be placed adjacent the housing 43. A concrete or steel cover 50 is mounted on the plate 49 and around the pipes 47 and extend laterally to the top of the decorative chimney 57. The pipes 47 preferably project about 2 inches above the cover 50. Suitable roof flashing 58 is provided around the base of the decorative chimney 50 as is conventional practice.

At the top of the housing 43 and adjacent the air inlet opening 51 is provided an opening 52. At the bottom of the housing 43 is provided a conduit 53 with an opening 54 leading to the bottom of the fire chamber 16. As can be seen from FIG. 1, housing 43 and pipes 47 form a chamber 55 which acts as a heat exchanger 56.

Preferably the units 21 and 56 are preassembled and installed in a home with a boom crane which first lowers the unit 21 onto the fireplace and then the unit 56 on the unit 21. The contractor can then connect conventional heating ducting to the unit such as that used wiht a conventional forced hot air furnace with which the chimney furnace of the present invention is compatible.

The operation of the heat exchanger units 21 and 56 are best described by reference to the schematic diagram of FIG. 7. The exchanger units 21 and 56 function separately and the unit 56 while preferred, is not necessary to the operation of the unit 21.

In operation of the unit shown in FIGS. 1 to 7, a fire is lit in the fire chamber 16 of the fireplace 15 by introducing a solid fuel (coal or preferably wood) or by igniting a gas or liquid fuel heater (not shown). Air is supplied to the chamber 16 through opening 51 to conduit 38 with the valve 39 completely open. The flue gases pass through the openings 25 in the tubes 24 and through the openings 48 in the tubes 47 and are vented outside the building 10. The tubes 24 are in heat exchange relationship with air in chamber 33 in the housing 26. The air in chamber 33 is circulated across the outside of the tubes 24 by inlet through conduits 34 and outlet through conduit 35 to the room(s) either by natural convection wherein hot air rises naturally and preferably by using a blower 59 in the conduit 34. A thermostat 60 electrically actuates the blower 59 at a preselected temperature in the chamber 33 in the housing 26.

Natural convection with hot air rising continuously circulates air through the exchanger 21. As can be seen the exchanger 21 provides an economic means of capturing substantial amounts of heat from the flue gases which would be lost by a conventional chimney. The valve 39 is rotated by a motor (not shown) controlled by the thermostat 40 which regulates the amount of air to the fire chamber 16 and as the fire reaches a stable condition the amount of air needed is smaller.

It is preferred to use the second exchanger 56 since it provides an additional means of removing heat from the flue gases and secondly provides a means of regulating a solid fuel fire at various stages during its development. When the fire is beginning, air enters the opening 52 and passes across the outside of the pipes 47 in chamber 55. The air then is conveyed to the fire chamber 16 by means of conduit 53, thus aiding the ignition of solid fuel because of the preheated air. As the temperature of the flue gases in the fire chamber 16, tubes 24 and pipes 47 increases, the flow of air in the exchanger 56 reverses due to natual convection and air from the bottom of the fire chamber 16 passes through the conduit 53, chamber 55 and out the opening 52. In the preferred apparatus shown in FIG. 1 this air is not vented to outside the building 10, but rather is recycled as preheated air through conduit 38 because of the plenum 58 formed by the decorative chimney 57.

Excellent results are achieved in the use of the apparatus of the present invention to heat a house such as shown in FIG. 1 with 2400 square feet of floor space including both floors and with a thermal resistance factor "R" factor of the batt insulation in the outside walls of 13 and the ceiling of 30 which is comparable to a well insulated house. The exchanger units 21 and 56 in a fireplace burning wood were able to maintain the temperature in the second floor rooms between about 65° F and 70° F over a 7 to 9 hour period after the fire was banked in the evening. The fire was banked by putting ashes on top of the wood to slow burning.

The advantages of the fireplace chimney furnace are:

1. The unit is used in place of a chimney and utilizes heat that has already escaped the fireplace, thereby greatly increasing heating efficiency.

2. By supplying combustion air from outside the building, the fireplace can function independent of the heated air inside the house, thus preventing heat loss through the chimney. The outside air conduit lends itself to simplified draft control which increases the length of time a fire can be banked and held. By using outside air for combustion, the fireplace will function properly in a modern, well insulated, tightly constructed home without need of front opening in the fireplace for combustion air. Another problem is that in a tightly constructed building with a conventional fireplace the fire uses up air and begins to die out unless outside air ventilation is provided to supply air to the fire.

3. The preferred secondary exchanger 56 functions mainly as an automatic draft control and chimney pipe 47 cooling unit. As discussed, the air draft is down when the heat product is low and reverses upwards as heat builds up in the exchangers.

4. The primary exchanger 21 functions equally well in gravity flow or forced air systems or a combination thereof.

FIG. 8 illustrates a variation of the present invention in a schematic cross-sectional view of a building 100. The building includes standard footings 101, a first floor 102, outside walls 103, inside walls 104, ceiling 105 and roof 106. As with the chimney furnace of FIG. 1, a fireplace 107 supports a heat exchanger 108 which is comprised of multiple tubes 109 through which pass the flue gases from the fireplace 107. The fireplace is closed by doors 110 or other closure means. At the top end of the exchanger 108, a pair of steel flue gas pipes 111 collect the flue gases from the exchanger 108 and vent them to the atmosphere outside the building 100. The pipes 111 are supported by a rectangularly cross-sectioned sheet metal box 112 with cooling vents 113 on two opposing sides of the box 112. A sheet metal cover 114 supports the uppermost ends of the tiles 111 in the box 112. A concrete or the like cap 115 is fitted over the metal cap 114 and extends laterally away from pipes 111. Below the circumference of the cap 115 is a conventional wood framing 116 which provides a decorative chimney. At one side of the framing 116, are provided an air inlet louver 117. The louver 117 provides combustion air to conduits 118 and 119 leading to the bottom of the fireplace 107. As can be seen, the vents 113 expel warmed air from the tiles 111 which can be utilized for combustion by entry through conduit 118. The conduit 118 is provided with a butterfly valve 119 and thermostatic control 120.

In the device of FIG. 8, an air blower 121 is used to feed cold air to the exchanger 108 via conduit 122. The air is warmed by the tubes 109 in the shell space or chamber 123 and then exits via conduit 124 to a plenum 125 between ceiling 105 and the roof 106. The plenum 125 is ducted to the room(s) via conduit 126 in the ceiling 105. The plenum 125 could be located in any convenient out of the way space. The room(s) are provided with cold air return ducts 127 which lead to the inlet side of the blower 121. The blower 121 is operated by a motor 128 and belt 129. The operation of the blower motor 128 is controlled by thermostat 130.

In operation, the fireplace chimney of FIG. 8 is similar to that of FIG. 1 except that the plenum 125 stores heated air until it is circulated to the room(s) by the blower 121. The blower 121 is activated in a conventional manner by the thermostat 130 which is attached to the upper part of the exchanger 108 and senses the temperature in the chamber 123. The blower turns on when the temperature in the chamber 123 reaches a preselected temperature.

As can be seen from the foregoing description, the fireplace chimney furnace of the present invention is unique in that it can be used to replace a conventional fireplace chimney and can be used with any type of fireplace. The chimney furnace is best installed at same time as fireplace but can be added afterwards by removing and replacing a conventional chimney.

I claim:

1. In a building with a fireplace having a combustion chamber, a front opening leading into a room and means for closing the opening and having a flue gas exit from the fireplace, the improvement as a replacement for a conventional fireplace chimney which comprises:

a. multiple heat exchanging tubes mounted above the flue gas exit of the fireplace such tht the flue gases vent upward through vertically oriented openings in the tubes, wherein the tubes extend substantially between at least the exit of the fireplace and a ceiling of a room of the building;

b. a housing surrounding, supporting and enclosing the tubes except for the openings with at least one conduit from a room of the building for cold air inlet into the housing and at least one conduit for hot air exit from the housing into at least one room of the building wherein the tubes and housing are in the form of a heat exchanger unit;

c. a chimney sealed in gaseous connection with the openings in the tubes and leading outside the building which provides an exit for the flue gases from the tubes of the heat exchanger; and d. an air conduit leading from outside of the building to the bottom of the combustion chamber including a thermostatically controlled valve in the conduit which regulates the amount of air to the chamber.

2. The building of claim 1 wherein the vertically oriented tubes extend above and below at least one floor into two rooms of the building.

3. The building of claim 1 wherein the outside air conduit and heat exchanger housing are enclosed by a separate enclosure from the rooms in the building.

4. The building of claim 1 wherein a second tubular heat exchanger is mounted above the first heat exchanger such that the flue gases can pass inside the second tubes from the first exchanger, wherein the second tubes are enclosed by a second housing, wherein the air conduit is provided in the second housing such that air can pass around the second tubes and wherein a conduit is provided leading from the second housing to the bottom of the combustion chamber.

5. The second heat exchanger of claim 4 wherein the second tubes are part of the chimney from the multiple heat exchanger tubes.

6. The building of claim 4 wherein the air inlet conduit is surrounded by a plenum formed in a roof top chimney housing.

7. The building of claim 1 wherein the air is circulated across the exchanger tubes and into the room by means of a blower in the cold air inlet conduit adjacent the exchanger housing.

8. The building of claim 7 wherein a plenum is provided in the hot air exit conduit for storage of the heated air prior to operation of the blower.

9. The building of claim 1 wherein the cold air conduit inlet is positioned near the floor and wherein the hot air conduit exit is near the ceiling of the room such that the cold air is circulated across the tubes in the housing, out the hot air conduits and into the rooms continuously by natural convection.

10. The building of claim 9 wherein the hot air conduit directs the heated air leaving the housing upward and into the rooms at an angle of between about 30° to 45° from the horizontal.

11. A heat exchanger for installation in a building with a fireplace having a combustion chamber, a front opening leading into a room and having a flue gas exit from the fireplace, as a replacement for a conventional fireplace chimney which comprises:

a. multiple heat exchanging tubes mounted above the flue gas exit of the fireplace such that the flue gases vent upward through vertically oriented openings in the tubes wherein the tubes will extend substantially between at least the exit of the fireplace and a ceiling of a room of the building when installed;

b. a housing surrounding, supporting and enclosing the tubes with at least one opening adapted for attachment to a cold air inlet conduit which leads into the housing from a room of the building and at least one opening adapted for attachment to a hot air exit conduit which leads from the housing into at least one room of the building wherein the tubes and housing are in the form of a heat exchanger unit; and c. cold and hot air conduits adapted to lead from at least one room of the building and to be attached to the inlet and exit openings in the housing.

12. The exchanger of claim 11 wherein the cold air inlet is adapted to fit an air blower.

* * * * *